US008086449B2

(12) United States Patent
Ishii et al.

(10) Patent No.: US 8,086,449 B2
(45) Date of Patent: Dec. 27, 2011

(54) VOCAL FRY DETECTING APPARATUS

(75) Inventors: Carlos Toshinori Ishii, Kyoto (JP); Hiroshi Ishiguro, Kyoto (JP); Norihiro Hagita, Kyoto (JP)

(73) Assignee: Advanced Telecommunications Research Institute International, Kyoto (JP)

( * ) Notice: Subject to any disclaimer, the term of this patent is extended or adjusted under 35 U.S.C. 154(b) by 988 days.

(21) Appl. No.: 11/990,396

(22) PCT Filed: Dec. 20, 2005

(86) PCT No.: PCT/JP2005/023365

§ 371 (c)(1),
(2), (4) Date: Feb. 13, 2008

(87) PCT Pub. No.: WO2007/026436

PCT Pub. Date: Mar. 8, 2007

(65) Prior Publication Data

US 2009/0089051 A1 Apr. 2, 2009

(30) Foreign Application Priority Data

Aug. 31, 2005 (JP) ..... 2005-250454

(51) Int. Cl.
*G10L 11/04* (2006.01)

(52) U.S. Cl. ..... 704/207; 704/217

(58) Field of Classification Search ..... 704/207–210, 704/214–218, 226, 233
See application file for complete search history.

(56) References Cited

U.S. PATENT DOCUMENTS

| | | | | |
|---|---|---|---|---|
| 5,699,483 | A * | 12/1997 | Tanaka | 704/219 |
| 5,963,895 | A * | 10/1999 | Taori et al. | 704/207 |
| 7,890,323 | B2 * | 2/2011 | Akamatsu | 704/230 |
| 2005/0055204 | A1 * | 3/2005 | Florencio et al. | 704/233 |

OTHER PUBLICATIONS

C.T. Ishii., "Analysis of Autocorrelation-based parameters for Creaky Voice Detection," Proc. of the 2nd International Conference on Speech Prosody: 643-646, 2004.

G. Klasmeyer, "The perceptual importance of selected voice quality parameters", Proceedings of the 1997 International Conference on Acoustics, Speech and Signal Processing (ICASSP-97), vol. 3, pp. 1615-1618, Apr. 21, 1997.

D. Dufournet et al., "New Tools for "squeak-and-rattle" automatic detection", Proceedings of the 1999 International Congress on Noise Control Engineering (inter-noise 99), vol. 3, pp. 1877-1880, Dec. 6, 1999.

P. Hedelin et al., "Pitch period determination of aperiodic speech signals", Proceedings of the 1990 International Conference on Acoustics, Speech and Signal Processing (ICASSP-90), vol. 1, pp. 361-364, Apr. 3, 1990.

Xuejing Sun, "Voice quality conversion in TD-PSOLA speech synthesis", Proceedings of the 2000 International Conference on Acoustics, Speech and Signal Processing (ICASSP-00), vol. 2, pp. 953-956, Jun. 5, 2000.

Yoshizawa et al., "Koeshitsu to Spectrum Kozo no Kankei", The Acoustical Society of Japan (ASJ) 1999 Nen Shunki Kenkyu Happyokai Koen Ronbunshu, vol. 1, 1-3-3, pp. 185-186, Mar. 10, 1999.

* cited by examiner

*Primary Examiner* — Abul K Azad
(74) *Attorney, Agent, or Firm* — Harness, Dickey & Pierce, P.L.C.

(57) ABSTRACT

A VF detecting apparatus capable of highly accurate vocal fry (VF) detection includes: a very-short-term peak detection processing unit framing a speech signal with a first frame of a first frame length and first frame shift amount and detecting each power peak; a short-term periodicity detecting unit framing the speech signal with a second frame of a second frame length longer than the first frame length and a second frame shift amount larger than the first frame length and determining presence/absence of periodicity in each of the resulting frame; a periodicity checking unit for detecting power peaks in those frames determined to have no periodicity, from among the detected power peaks; and a similarity checking unit for detecting, for each of the selected power peaks, neighboring power peaks having high cross-correlation and detecting the section therebetween as the VF section.

6 Claims, 7 Drawing Sheets

VOCAL FRY DETECTING APPARATUS

TECHNICAL FIELD

The present invention relates to a technique for analyzing human voice quality and, more specifically, to a vocal fry (hereinafter referred to as "VF") detecting apparatus for detecting a segment of a specific voice quality referred to as vocal fry, in speech signals.

BACKGROUND ART

In human-machine communication scenario, it is necessary to automatically extract information other than text-based information (hereinafter referred to as "paralinguistic information") in speech. Conventionally, prosodic features such as pitch, power and duration have been used as acoustic features for extracting paralinguistic information. Recent studies, however, have reported that voice quality information due to modality in the laryngeal voice source, for example, breathiness, creakiness and harshness also takes an important role in the perception of paralinguistic information.

VF, creak, creaky voice, glottal fry, pulse register and laryngealization are terminologies conventionally found in the literature for a voice quality characterized by a train of relatively discrete laryngeal (or glottal) excitations (or pulses of brief duration), with almost complete damping of the vocal tract between successive glottal pulses, usually accompanied by extremely low fundamental frequencies, and irregular durations of glottal cycles. The auditory perception of VF is of "rapid series of taps like a stick being run along a railing" or the "imitated sound of motor boat engine" or similar to "food cooking in a hot frying pan."

VF carries important linguistic and paralinguistic information depending on the language. In German, VF often occurs near morpheme boundaries. In Japanese, besides the VF appearing in low tension voices, it also appears in expressive emphasizing utterances as a pressed voice. Such pressed voice carries paralinguistic information primarily associated with feelings or attitudes of surprise, admiration and suffering. VF utterance portions (hereinafter referred to as "VF segments") in such pressed voices are often observed to have very low fundamental frequencies.

Further, VF segments have characteristic irregularities, possibly causing severe errors in pitch determination algorithms, which are important for prosodic information extraction. Thus, knowledge about the location of VF could be useful in extracting paralinguistic information as well as in improvement of pitch determination performance.

There are many studies reporting physiological, perceptual and acoustic properties of VF in several research areas. Many of them report qualitative or descriptive analyses of acoustic features that are related with different voice qualities. However, only a few evaluate their performance for automatic detection purposes.

Non-Patent Document 1: Ishi, C. T., "Analysis of Autocorrelation-based parameters for Creaky Voice Detection," Proc. of The 2nd International Conference on Speech Prosody: 643-646, 2004.

DISCLOSURE OF THE INVENTION

Problems to be Solved by the Invention

The fundamental frequency ranges for VF are reported as being consistently lower than 100 Hz, with averages around 24 to 52 Hz. The glottal pulses in VF can be associated with two or even three pulses in a rapid succession followed by a period of significant vocal tract damping.

Many acoustic analyses of VF have been conducted in temporal, spectral and cepstral domains. Usual methods evaluate periodicity (or harmonicity) properties using a short-term analysis frame with fixed length.

A problem of using fixed length frame arises when VF segments have very low fundamental frequencies (that is, very large inter-pulse time intervals). In a standard (commonly used) analysis frame length around 25 to 32 milliseconds, it is often the case that only one glottal pulse lies within the analysis frame in VF segments, and sometimes, no glottal pulse lies within the frame. The presence of at least two glottal pulses within the analysis frame would be necessary for some harmonic structure in the spectrum to appear, or for autocorrelation peaks reflecting some short-term periodicity between glottal pulses to appear.

A simple approach to this problem could be taken by increasing the analysis frame length. In Non-Patent Document 1, autocorrelation-based periodicity analysis was conducted using an adaptively variable frame length. However, such solution solves only part of the problem, since more than two glottal pulses with different inter-pulse intervals may be present within a large analysis frame. This would disturb the harmonic structure in the spectrum, or reduce the magnitude of autocorrelation (or cepstral) peaks.

Therefore, an object of the present invention is to provide a VF detecting apparatus capable of highly accurate VF detection while avoiding the problems of disturbance of harmonic structure in the spectrum or reduced peaks of autocorrelation.

Another object of the present invention is to provide a VF detecting apparatus capable of highly accurate VF detection with a method in synchronization with glottal pulses, while avoiding the problems of disturbance of harmonic structure in the spectrum or reduced peaks of autocorrelation.

A further object of the present invention is to provide a VF detecting apparatus capable of highly accurate VF detection with a method in synchronization with glottal pulses, while avoiding the problems of disturbance of harmonic structure in the spectrum or reduced peaks of autocorrelation, by using an appropriate analysis frame.

Means for Solving the Problems

According to a first aspect, the present invention provides a VF detecting apparatus for detecting a VF section in a speech signal, including: first framing means for framing the speech signal with a first frame having a first frame length and a first frame shift amount; power peak detecting means for detecting power peak in each of a series of first frames output from the first framing means; second framing means for framing the speech signal with a second frame having a second frame length longer than the first frame length and a second frame shift amount larger than the first frame shift amount; periodicity determining means for determining presence or absence of periodicity in each of a series of second frames output from the second framing means; power peak selecting means for selecting, from among the power peaks detected by the power peak detecting means, a power peak in the second frame determined by the periodicity determining means to have no periodicity; and means for searching, for each of the power peaks selected by the power peak selecting means, for a power peak having cross-correlation with another power peak in a prescribed section including the power peak, larger than a prescribed threshold, and detecting the prescribed section including the power peak in the speech signal as the VF section.

In the speech signal framed with the first frame, the power peak is detected. In the speech signal framed with the second frame signal, presence/absence of periodicity is determined. The first frame has shorter frame length and smaller amount of frame shift than the second frame. Therefore, in the speech signal framed with the first frame, even the waveform having low fundamental frequency can be detected with higher accuracy than in the speech signal framed with the second frame. On the other hand, the frame length of the second frame is longer than the first frame and, therefore, presence of periodicity therein can more accurately be determined. Of the detected power peaks, one existing at a portion of no periodicity is highly likely the VF pulse. Further, if such a VF pulse candidate has high correlation with another, neighboring pulse in a prescribed section, it is more likely that the candidate is a VF pulse. As the section including a power peak corresponding to the VF pulse as such is detected as the VF section, the VF section can be detected with high accuracy. As the first and second frames are used for processing, frames appropriate for signal processing can be utilized, allowing VF detection with high accuracy.

Preferably, the power peak detecting means includes: a power peak candidate detecting means for detecting, from a series of first frames, one having larger power than any other frames in a prescribed section including the frame and the difference is larger than a predetermined first threshold value, as the power peak candidate; and means for detecting, from the power peak candidates detected by the power peak candidate detecting means, one having larger power than each frame in a section wider than the prescribed section and the maximum value of difference is larger than a predetermined second threshold value, as the power peak.

More preferably, the section wider than the prescribed section refers to a section corresponding to 10 milliseconds of the speech signal.

More preferably, the periodicity determining means includes: means for calculating, in each of the series of second frames, in-frame periodicity measure of the maximum power peak in the frame, as a function of auto-correlation in a prescribed lag range in the frame, and for determining presence or absence of periodicity, depending on whether auto-correlation peak is larger than a prescribed threshold function or not.

The determining means may calculate the measure for periodicity by multiplying an autocorrelation value related to the maximum power peak by a function as a monotonically decreasing function of a lag from the maximum power peak in the frame of interest.

Preferably, the prescribed threshold function is obtained by multiplying a predetermined constant larger than 0 and smaller than 1 by the monotonously decreasing function.

More preferably, the periodicity determining means further includes periodicity correcting means for correcting a value of periodicity measure of the second frames at portions other than portions where frames having periodicity measures larger than a predetermined constant continue by a prescribed number, among the second frames determined to have periodicity by the determining means, to a value that is to be determined to have no periodicity.

Further preferably, the apparatus further includes filtering means for filtering out frequency components outside a prescribed frequency band of the speech signal, before applying the speech signal to the first and second framing means.

According to a second aspect, the present invention provides a storage medium storing a computer program that causes, when executed by a computer, the computer to operate as any of the VF detecting apparatuses described above.

DESCRIPTION OF REFERENCE CHARACTERS

Figure 1:
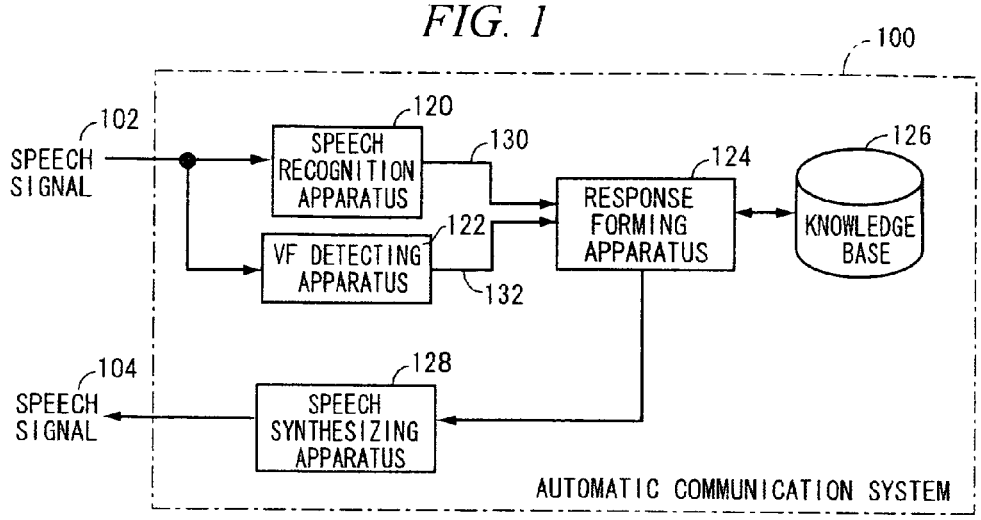
FIG. 1 is a block diagram of an automatic communication system 100 adopting a VF detecting apparatus 122 in accordance with an embodiment of the present invention.

100 an automatic communication system
102, 174 a speech signal
120 a speech recognition apparatus
122 a VF detecting apparatus
124 a response forming apparatus
126 a knowledge base
128 a speech synthesizing apparatus
132 VF section information
162 a very-short-term peak detection processing unit
164 a short-term periodicity detecting unit
166 a periodicity checking unit
168 a similarity checking unit
170 peak position information
172 short-term periodicity information
176 VF candidate information
190, 250 a framing unit
192 a very-short-term power calculating unit
196 a peak comparing unit
254 an IFP calculating unit
258 a periodicity determining unit
260 a continuity checking unit
310 an IPS calculating unit
312 an IPS comparing unit
314 a threshold value storing unit
316 a VF segment determining unit

BEST MODES FOR CARRYING OUT THE INVENTION

<Overview>

To solve the frame length problem, the inventors of the present invention decided to realize a glottal pulse-synchronized processing, when no periodicity can be found within the fixed length analysis frame. For this purpose, in the present embodiment, candidates for glottal pulses are detected based on the damping and low fundamental frequency properties of VF. This is based on the phenomenon that damping in large inter-pulse intervals is characterized by an up and down movement in the amplitude envelope, or in a local power contour, of the speech signal.

Another problem regarding automatic VF detection is that most acoustic analyses evaluate temporal or spectral features of pre-segmented voiced parts of the speech signal. In a real problem of automatic VF detection from the whole speech utterance including consonants and non-speech segments, many insertion errors might occur since such segments also usually have a periodic characteristics. Thus, the problem is how to discriminate between the aperiodicity caused by VF and reverberations caused by consonants and background non-speech signals.

In order to solve this problem, the present invention introduces evaluation of similarity measure between successive (or close) glottal pulses. The measure is based on an assumption that the vocal tract configuration does not change much between generations of two glottal pulses and thus, the vocal tract responses are expected to be similar.

<Configuration>

FIG. 1 is a block diagram of an automatic communication system 100 adopting a vocal fry detecting apparatus 122 in accordance with an embodiment of the present invention. Referring to FIG. 1, automatic communication system 100 includes a speech recognition apparatus 120 performing speech recognition on an incoming speech signal 102 and outputting a speech recognition result 130 as text data, and a VF detecting apparatus 122 detecting a VF section in speech signal 102 and outputting VF section information 132.

Automatic communication system 100 further includes: a response forming apparatus 124 receiving the speech recognition result 130 from speech recognition apparatus 120 and VF section information 132 from VF detecting apparatus 122, integrating paralinguistic information processing using VF section information 132 with the speech recognition result 130 to understand speaker intentions, and outputting text information and voice quality information to provide appropriate response; a knowledge base 126 referred to by response forming apparatus 124 when forming the response, storing knowledge enabling formation of appropriate response for the combination of text information and paralinguistic information of the speech; and a speech synthesizing apparatus 128 synthesizing speech from the text information of the response output from response forming apparatus 124 with voice quality instructed by response forming apparatus 124 and outputting as a speech signal 104. The speech signal 104 is converted to an analog signal by a circuit, not shown, amplified and supplied to a speaker.

Figure 2:
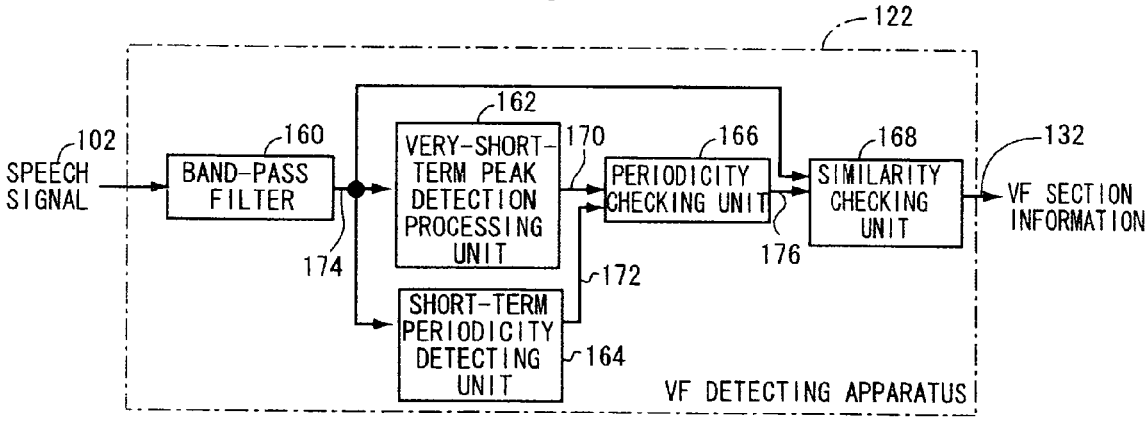
FIG. 2 is a block diagram of VF detecting apparatus 122 in accordance with an embodiment of the present invention.

FIG. 2 is a block diagram of VF detecting apparatus 122. Referring to FIG. 2, VF detecting apparatus 122 includes a band-pass filter passing only the frequency component of 100 to 1500 Hz, retaining most information about periodicity, of the speech signal 102. Frequency component lower than 100 Hz retain DC components and gradually rising or falling components that would affect periodicity analysis and, therefore, these are filtered out by band-pass filter 160. Frequency components above 1500 Hz contain high frequency noise components, and therefore, these are also filtered out. The pass Band of the band-pass filter is selected to allow detection of peaks and valleys from power curves, for each of the glottal pulses in the VF segments.

VF detecting apparatus 122 further includes: a very-short-term peak detection processing unit 162 detecting a local power peak in the output of band-pass filter 160 as a VF pulse candidate using a frame having the frame length of 5 milliseconds and frame interval of 2.5 milliseconds (in the present specification, referred to as a "very-short-term frame") and outputting peak position information 170; and a short-term periodicity detecting unit 164 detecting a portion not having short-term periodicity indicating possible presence of VF in the output of band-pass filter 160 discriminating from other portions, using a commonly used frame having the frame length of 25 to 32 milliseconds and frame length of 10 or 5 milliseconds (in the present specification, referred to as a "short-term frame"), and outputting short-term periodicity information 172.

VF detecting apparatus 122 further includes: a periodicity checking unit 166 for receiving peak position information 170 from very-short-term peak detection processing unit 162 and short-term periodicity information 172 from short-term periodicity detecting unit 164, respectively, for selecting, as a VF frame candidate, frames including respective peaks at portions where no short-term periodicity exists from among peaks indicated by peak position information 170, and for outputting as VF candidate information 176; and a similarity checking unit 168 for identifying only the VF candidate having a similar pulse within prescribed preceding and succeeding ranges as the VF, for using VF candidate information 176 output from periodicity checking unit 166 and speech signal 174 having frequency components of 100 to 1500 Hz output from band-pass filter 160, and for outputting a VF section information 132 indicating the section where VF exists.

Figure 3:
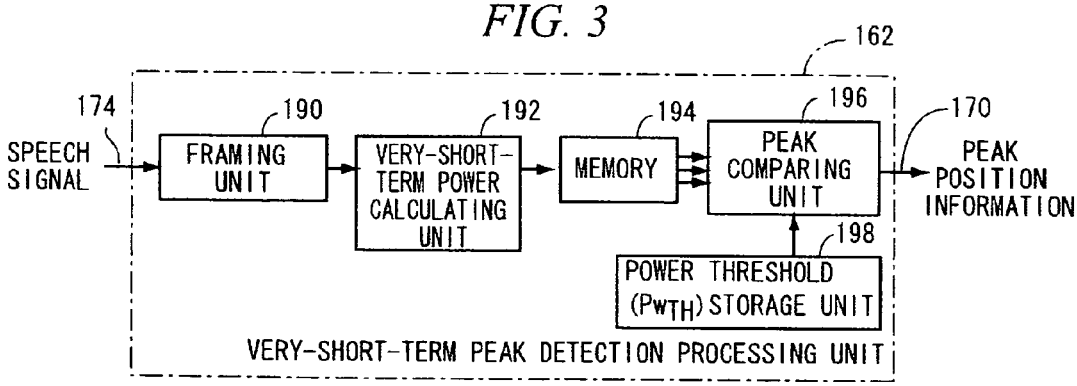
FIG. 3 is a block diagram of a very-short-term peak detection processing unit 162.

FIG. 3 is a block diagram of very-short-term peak detection processing unit 162. Referring to FIG. 3, very-short-term peak detection processing unit 162 includes: a framing unit 190 for framing speech signal 174 having the frequency components of 100 to 1500 Hz output from band-pass filter 160 into very-short-term frames; a very-short-term power calculating unit 192 for calculating and outputting power (referred to as "very-short-term power") for each of the very-short-term frames output by framing unit 190; a memory 194 for storing a prescribed number of latest values of the series of very-short-term powers output by very-short-term power calculating unit 192; a peak comparing unit 196 for specifying the power that is larger than the very-short-term powers of preceding frame and succeeding one frame with respective differences being larger than a prescribed power threshold value PwTH (for example, 6 to 7 dB) from among the very-short-term powers stored in memory 194, for estimating the specified power to be a candidate of VF glottal pulse, and for outputting the peak position as peak position information 170; and a power threshold value storage unit 198 for storing the power threshold value PwTH used by the peak comparing unit 196.

Figure 4:
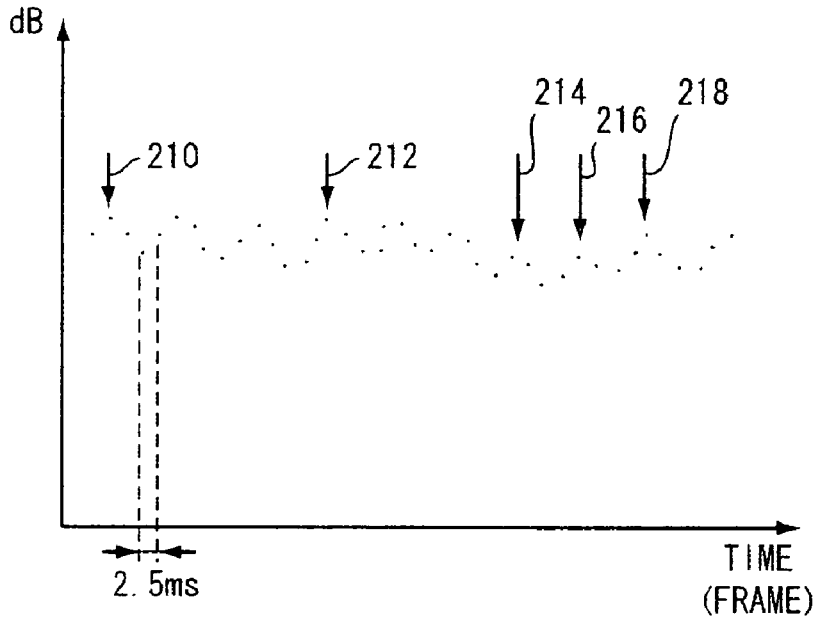
FIG. 4 shows a principle of peak detection at very-short-term peak detection processing unit 162.
Figure 5:
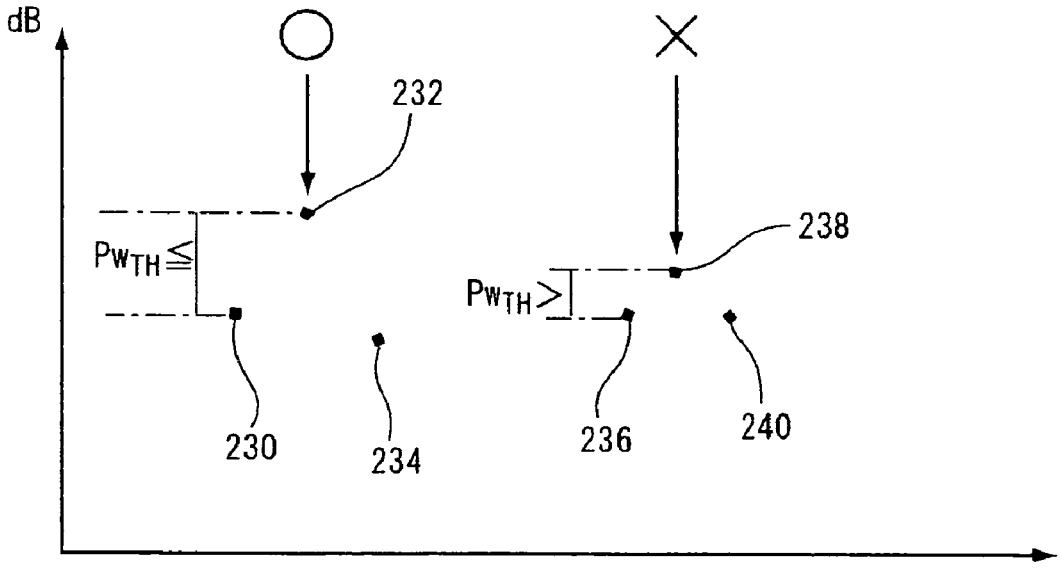
FIG. 5 shows a principle of peak detection at very-short-term peak detection processing unit 162.

FIGS. 4 and 5 illustrate the principle of peak detection by peak comparing unit 196. Referring to FIG. 4, for each very-short-term frame having the frame length of 5 milliseconds and frame interval of 2.5 milliseconds, very-short-term power calculating unit 192 calculates the power, so that power values with intervals of 2.5 milliseconds are obtained. Among these power values, those that are larger than preceding and succeeding power values as indicated by arrows 210, 212, 214, 216 and 218 may be peak candidates. In the present embodiment, among these peak candidates, one satisfying the following conditions is regarded as a peak candidate.

Referring to FIG. 5, assume that the power value 232 is larger by power threshold value PwTH or more than power values 230 and 234 of preceding and succeeding two frames. In the present embodiment, the frame having such a power value is regarded as the peak candidate. The power value, represented by power value 238 here, of which difference from the power value 236 or 240 of preceding and succeeding two frames is smaller than the power threshold value PwTH, is excluded from the peak candidate.

Figure 6:
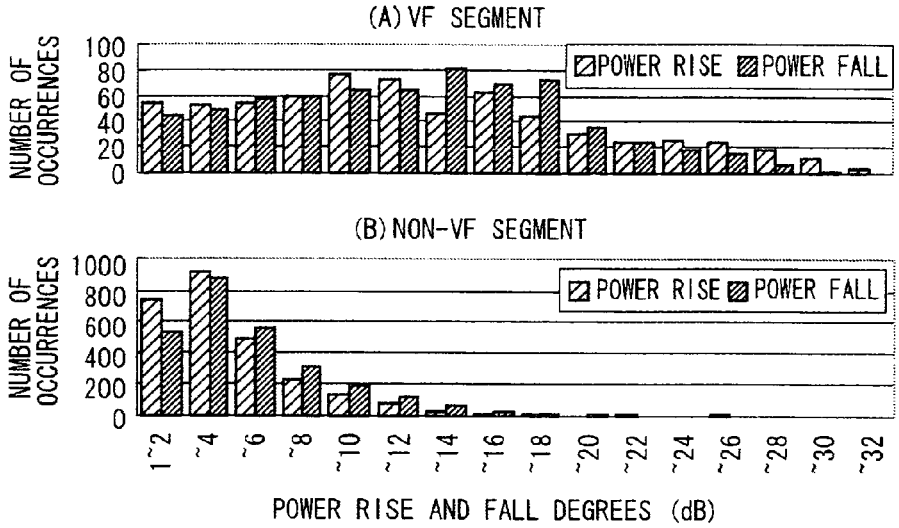
FIG. 6 is a graph representing experimental results of distributions of power rise and power fall of peaks in VF and NF segments.

FIGS. 6(A) and 6(B) show experimental results of distributions of the peak power rise and power fall of VF segments and non-VF (hereinafter denoted as "NF") segments, respectively. The amount of peak rise and fall here refers to the difference between the peak of a certain frame and the power of four preceding frames (that is, the power in an interval of 10 milliseconds before the peak). From FIG. 6(A), presence of large values for both powers rising and falling can be seen, reflecting the damping property of VF. In contrast, NF segments show predominance of both powers rising and falling around a range of 1 to 6 dB, as shown in FIG. 6(B).

It is not necessarily clear from these figures what threshold value (power threshold value) is to be set for discriminating between VF and NF. The threshold value is selected based on a result of experiment as will be described later and, by way of example, the value of 7 dB is used as the threshold value.

Short-term periodicity detecting unit 164 shown in FIG. 2 has a function of further selecting, for each of the peak candidates determined in the above-described manner, the peak candidate that seems to be in a VF segment, among the peak candidates extracted by very-short-term peak detection processing unit 162.

Figure 7:
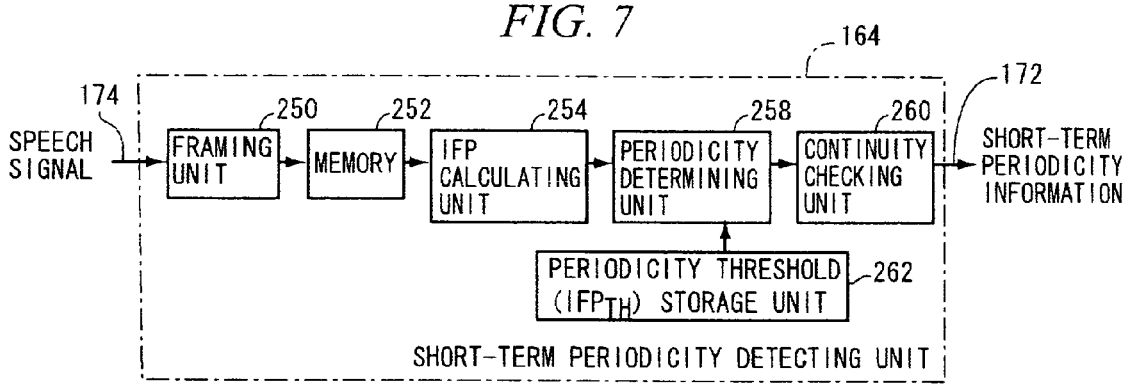
FIG. 7 is a block diagram of a short-term periodicity detecting unit 164.

Referring to FIG. 7, short-term periodicity detecting unit 164 includes: a framing unit 250 for framing the output of band-pass filter 160 with the frame length of 32 milliseconds and frame interval of 10 milliseconds; a memory 252 for storing the framed speech signal output by framing unit 250; an IFP calculating unit 254 for calculating, for each frame, Intra-frame periodicity (IFP) by autocorrelation analysis based on the speech signal of each frame stored in memory 252; a periodicity determining unit 258 for comparing the IFP value calculated for each frame by IFP calculating unit 254 with a prescribed periodicity threshold value IFPTH, and for setting, if any peak of the IFP value is lower than the threshold function, the IFP value of the corresponding frame to null, for determining that it has no periodicity; a continuity checking unit 260 for determining, based on the IFP values set by periodicity determining unit 258, only when three or more continuous frames have non-null IFP values, the segment to have short-term periodicity, and for outputting short-term periodicity information 172 indicating whether the frame has short-term periodicity or not; and a periodicity threshold function storage unit 262 for storing the periodicity threshold function IFPTH used by periodicity determining unit 258.

The IFP value of autocorrelation analysis by IFP calculating unit 254 is defined as the correlation value of the maximum peak, normalized by "frame length/(frame length−lag)." This normalization is for compensating the property of autocorrelation function as monotonous decreasing function that autocorrelation decreases as the lag increases.

Only autocorrelation peaks whose lags are smaller than 15 milliseconds (corresponding to fundamental frequency larger than about 66.7 Hz) are considered for periodicity analysis in IFP calculating unit 254. This means that at least two glottal cycles are present in the analysis frame.

Figure 8:
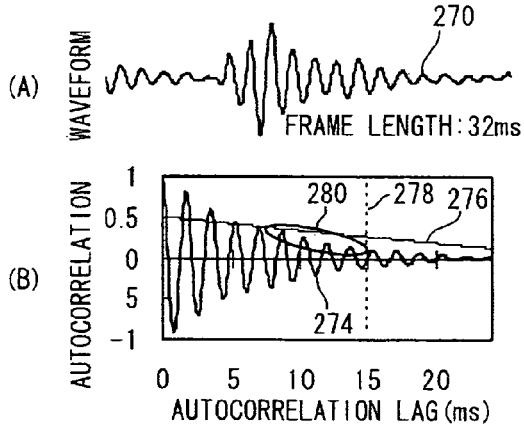
FIG. 8 shows sub-harmonic properties in the autocorrelation function for a single VF pulse in one frame.
Figure 9:
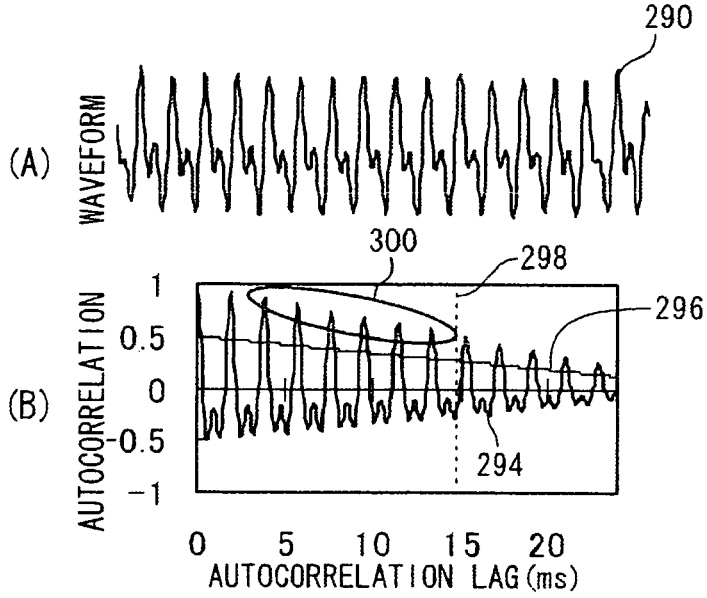
FIG. 9 shows sub-harmonic properties in the autocorrelation function for modal voice.

Periodicity determining unit 258 performs the following process on the autocorrelation peaks corresponding to fundamental frequencies larger than 200 Hz. Specifically, the periodicity of all sub-harmonics above 66.7 Hz is checked. This process prevents misdetection of periodicity due to strong harmonics around the first formant, rather than a periodicity due to repetition of glottal cycles. FIGS. 8 and 9 show sub-harmonic properties of autocorrelation function. FIG. 8 shows waveform and autocorrelation of VF including only one glottal pulse within one frame, and FIG. 9 shows waveform and autocorrelation of modal voice having high fundamental frequency, respectively. These are related to vowel /e/segments extracted from a female speaker voice. In FIGS. 8(B) and 9(B), solid lines 276 and 296 represent threshold function. The threshold function is defined as "prescribed constant×(frame length−lag)/(frame length)." As the prescribed constant, in the present embodiment, 0.5 is used. The threshold function is defined also taking into account the property of autocorrelation function as a monotonous decreasing function with respect to lags.

Referring to FIG. 9(B), for modal segment, the peaks of autocorrelation 294 of the sub-harmonics component of the strong harmonics in waveform 290.(FIG. 9(A)) are also usually strong. Sub-harmonics above 66.7 Hz (lags below 15 milliseconds, that is on the left side of dotted line 298) have autocorrelation peaks 300 higher than threshold function 296.

In contrast, referring to FIG. 8(B), for VF segment waveform 270 (FIG. 8(A)), though autocorrelation function has strong peaks, many sub-harmonics components have values 280 as values of autocorrelation function 274 smaller than the threshold function 276 while the lag is within 15 milliseconds (on the left side of dotted line 278). In the present embodiment, IFP calculating unit 254 has the function of calculating autocorrelation function of each sub-harmonics component. Periodicity determining unit 258 has a function of checking the IFP value calculated for each frame by IFP calculating unit 254 and setting null the IFP value of a frame if any of the peaks thereof is smaller than the value of the threshold function. Continuity checking unit 260 checks the IFP value for each frame output by periodicity determining unit 258, and only when three or more continuous frames have non-null IFP values, it determines that these frames have short-term periodicity, and otherwise it determines that the frames do not have short-term periodicity.

Figure 10:
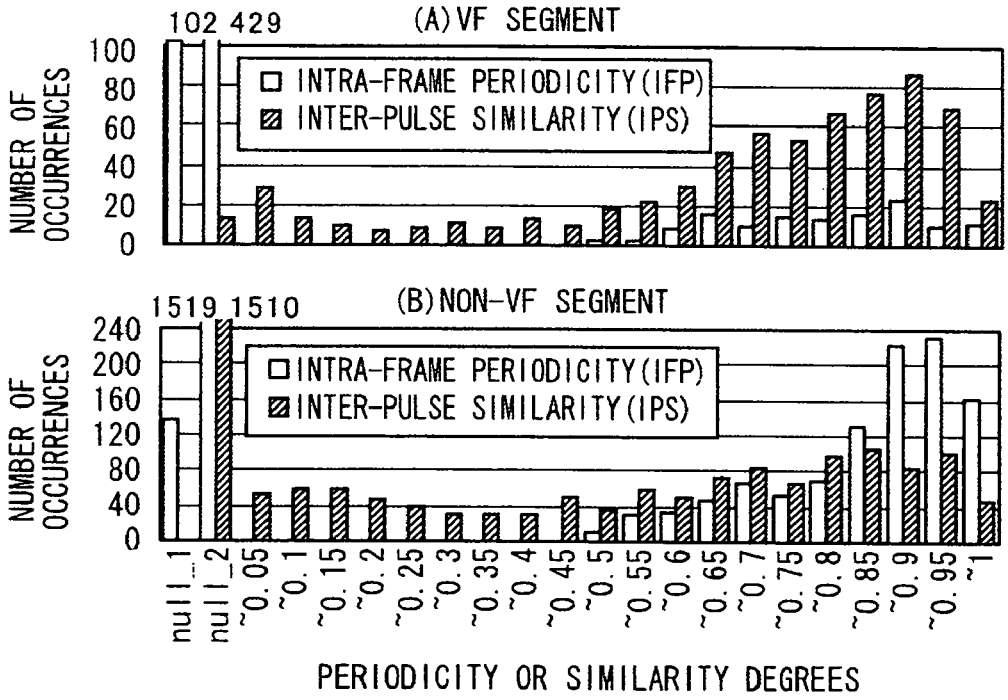
FIG. 10 is a graph showing distributions of IFP and IPS for VF and NF segments.

FIGS. 10(A) and 10(B) represent, in white bars, distributions of the IFP values obtained through experiments for VF and NF segments, respectively. In the figures, hatched bars relate to IPS values, which will be described later. Referring to FIGS. 10(A) and 10(B), frames having null IFP values are predominant in VF segments. In FIG. 10, "null_1" represents the number of frames having null IFP values due to sub-harmonics constraints (specifically, number of frames having strong autocorrelation peaks but weak autocorrelation peaks in sub-harmonics), and "null_2" represents the number of frames having null IFP values due to aperiodicity constraints (specifically, number of frames not having strong correlation peaks).

Periodicity checking unit 166 shown in FIG. 2 has a function of receiving peak position information 170 of VF segment candidates from very-short-term peak detection processing unit 162 and short-term periodicity information 172 from short-term periodicity detecting unit 164, respectively, selecting only the peak candidate of the frame having null IFP value and applying the same as VF candidate information 176 to similarity checking unit 168.

Figure 11:
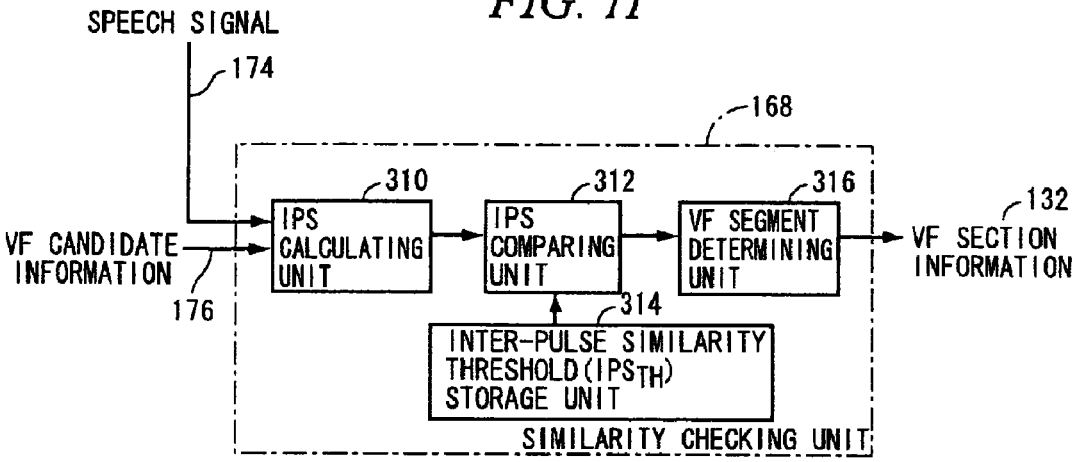
FIG. 11 is a block diagram of a similarity checking unit 168.

FIG. 11 is a block diagram of similarity checking unit 168 shown in FIG. 2. Referring to FIG. 11, similarity checking unit 168 includes: an IPS calculating unit 310 for calculating an inter-pulse similarity (IPS) value calculated as cross-correlation function between the waveform around each power peak and the ones around the previous power peaks, for the power peak candidates of VF segments that satisfied the conditions above, based on the speech signal 174 having frequency components of 100 to 1500 Hz and on VF candidate information 176 from periodicity checking unit 166; an inter-pulse similarity threshold value storage unit 314 for storing a threshold value IPSTH determined by an experiment that will be described later; an IPS comparing unit 312 for comparing the IPS value of each power peak output from IPS calculating unit 310 with the threshold value IPSTH stored in threshold value storage unit 314, for selecting only the power peaks above the threshold value IPSTH, and for outputting peak position information; and a VF segment determining unit 316 for merging, as VF segment, frames existing between neighboring (or close in a prescribed search scope) pulses having high IPS values, and outputting VF section information 132.

The IPS value calculated by IPS calculating unit 310 is calculated as cross-correlation function between the waveform around the power peak as the object of processing and the waveforms around the previous power peaks, as already described. The frame length for cross-correlation calculation is limited to 15 milliseconds, in order to avoid the interference of irregularly spaced glottal pulses in the similarity calculation.

Cross-correlation is estimated in a range of 5 milliseconds around the power peak position, and the maximum value is taken as the IPS value. High IPS values indicate high probability of the detected power peaks representing VF pulses. For calculation of the IPS value, the search range of power peaks is limited to 100 milliseconds before the object power peak, and cross-correlation with the power peak is calculated. The value of 100 milliseconds corresponds to the maximum time interval allowed between two glottal excitation pulses. The maximum value of excitation pulse corresponds to an extremely low fundamental frequency of 10 Hz.

FIGS. 10(A) and 10(B) are hatched bar graphs representing distributions of IPS values calculated by experiments for VF and NF segments, respectively. In the figures, white bars relate to IFP values described above. FIG. 10(A) shows a predominance of large IPS values concentrated around 0.8 to 0.95, in VF segments. On the contrary, a big value is observed in null_2 in NF segments. "Null_2" represents null values that were set because of the search range constraint to 100 milliseconds, indicating that no power peak was found in the range of 100 milliseconds immediately preceding the power peak. Null ISP values are hardly observed in FIG. 10(A).

Referring to FIG. 10(B), IPS values in NF segments can be grouped into two. One is a group of low IPS values, and the other is a group of high IPS values. The high IPS values are possibly resulting from periodicity in modal voice. Therefore, IFP values for this group should also be high. In contrast, white bars in the graph of FIG. 10(B) indicate that large IFP values are much observed in NF segments.

<Operation>

Automatic communication system 100 having the above-described configuration, particularly the VF detecting apparatus 122 operates as follows. Referring to FIG. 1, speech signal 102 input from a microphone or the like is digitized and applied to speech recognition apparatus 120 and VF detecting apparatus 122. Speech recognition apparatus 122 performs speech recognition process on the speech signal, and applies speech recognition result 130 including text information of highly possible results of speech recognition to response forming apparatus 124. VF detecting apparatus 122 performs the following operation to identify a frame that is considered to be a VF segment in the speech signal, and applies VF section information to response forming apparatus 124.

Response forming apparatus 124 accesses knowledge base 126 using the plurality of candidates included in speech recognition result 130 applied from speech recognition apparatus 120 and VF section information applied from VF detecting apparatus 122, and thereby forms a response that would be most relevant from the combination of the candidates of speech recognition result and the VF segment. The response consists of response text information and information designating voice quality of the response speech, and it is applied to speech synthesizing apparatus 128. Speech synthesizing apparatus 128 synthesizes speech signal 104 for reproducing the designated text information with the designated voice quality, and applies the signal to the speaker.

In the following, the operation of VF detecting apparatus 122 will be described. Referring to FIG. 2, speech signal 102 applied to VF detecting apparatus 122 is applied to band-pass filter 160. Band-pass filter 160 passes only the frequency components of 100 Hz to 1500 Hz of the speech signal 102, as speech signal 174. Speech signal 174 is applied to very-short-term peak detection processing unit 162, short-term periodicity detecting unit 164 and similarity checking unit 168.

Very-short-term peak detection processing unit 162 detects a power peak in a very-short-term frame through the following process, and applies as peak position information to periodicity checking unit 166. Specifically, referring to FIG. 3, framing unit 190 frames the speech signal 174 having the frequency components of 100 to 1500 Hz into very-short-term frames. The very-short-term frames have frame length of 5 milliseconds and frame shift of 2.5 milliseconds. The speech signal framed with the very-short-term frame is applied to very-short-term power calculating unit 192.

Very-short-term power calculating unit 192 calculates the very-short-term power for each frame, and applies the result to memory 194 for storage. Memory 194 stores values of the very-short-term powers for a prescribed number of latest frames.

Peak comparing unit 196 compares each frame with a preceding frame and a succeeding frame. If the power differences of the frames are larger than the power threshold value PwTH, the frame is regarded as a power peak candidate, and peak comparing unit 196 outputs peak position information 170 indicating the frame position, to periodicity checking unit 166.

Short-term periodicity detecting unit 164 shown in FIG. 2 detects periodicity of each frame and applies short-term periodicity information 172 to periodicity checking unit 166, in the following manner. Specifically, referring to FIG. 7, framing unit 250 frames the speech signal with frame length of 32 milliseconds and frame interval of 10 milliseconds, and stores it in memory 252.

IFP calculating unit 254 calculates the IFP value for each frame stored in memory 252, and applies the value to periodicity determining unit 258. Periodicity determining unit 258 corrects the IFP value of each frame applied from IFP calculating unit 254 by comparison with the threshold function. Specifically, if any sub-harmonic IFP value of each frame is smaller than the threshold value, periodicity determining unit 258 sets the IFP value of the frame to null. Periodicity determining unit 258 applies the IFP values of respective frames to continuity checking unit 260.

Regarding the IFP values of respective frames applied from periodicity determining unit 258, continuity checking unit 260 corrects, unless at least three continuous frames have non-null IFP values, the IFP values of the frames to null. The IFP value of each frame after the continuity check by continuity checking unit 260 is applied as short-term periodicity information 172 to periodicity checking unit 166 shown in FIG. 2.

Periodicity checking unit 166 takes only the portion corresponding to frames having null IFP values as the VF segment candidate, based on the short-term periodicity information 172 applied from short-term periodicity detecting unit 164, from peak position information 170 applied from very-short-term peak detection processing unit 162, and applies the same as VF candidate information 176 to similarity checking unit 168.

Referring to FIG. 11, IPS calculating unit 310 of similarity checking unit 168 calculates, for the power peak candidate specified by VF candidate information 176, the IPS value between the waveform around each power peak and the waveforms around previous power peaks, and applies the value to IPS comparing unit 312. IPS comparing unit 312 compares the IPS value of each power peak calculated by IPS calculating unit 310 with the threshold value IPSTH stored in threshold value storage unit 314, selects only the power peaks higher then the threshold value IPSTH, and outputs peak position information. The peak position information is applied to VF segment determining unit 316. Based on the peak position information output from IPS comparing unit 312, VF segment determining unit 316 merges frames between neighboring (or close in a prescribed search range) pulses having high IPS values as VF segment, and outputs VF section information 132. The VF section information 132 is applied to response forming apparatus 124 shown in FIG. 1.

<Evaluation of Automatic Detection>

Automatic detection of VF by VF detecting apparatus 122 in accordance with the above-described embodiment was evaluated through comparison between the duration (VFdur) of the automatically detected VF segment with a period manually determined to be VF and labeled as such (VFdur_human). In the following, the ratio between VFdur and VFdur_human will be referred to as VF ratio. The segment labeled as VF is considered as correctly detected only if VF ratio is ⅔ or higher. By counting the number of segments not labeled VF but determined by automatic detection to be VF (VFdur_ins), insertion error was checked. The detection result and insertion error result are grouped into two, that is, "detection" and "detection?," depending on detection performance or severity of the insertion error. The group "detection?" includes segments detected as "VF" with the VF ratios between ⅓ to ⅔, and insertions whose "VFdur_ins" values are shorter than 30 milliseconds.

Figure 12:
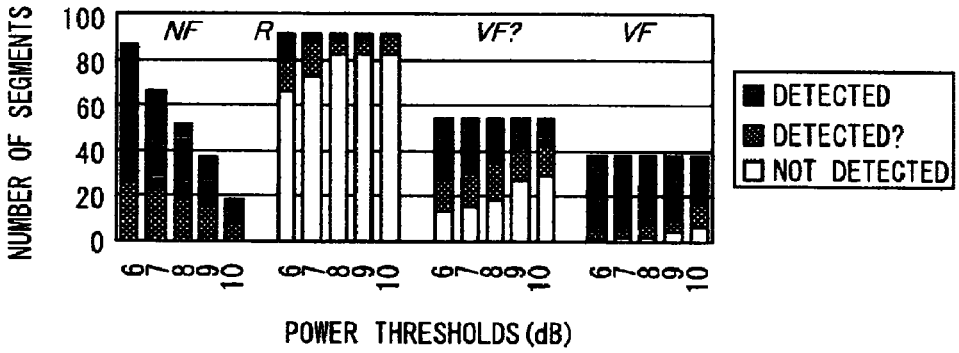
FIG. 12 shows experimental results by setting several power thresholds for IFP threshold=1 and IPS threshold=0.

Several combinations of parameter values involved in the embodiment above were tested, in order to reduce insertion errors without degrading detection performance. First, power peak thresholds were reset by adjusting the IPS value to 0.0 and IFP value to 1.0. This corresponds to using only power information. FIG. 12 shows detection results for different power threshold values. Referring to FIG. 12, high power thresholds reduce insertion errors (black and hatched portions of "NF" group) but also reduces detection rate (black and hatched portions of "VF" group).

Figure 13:
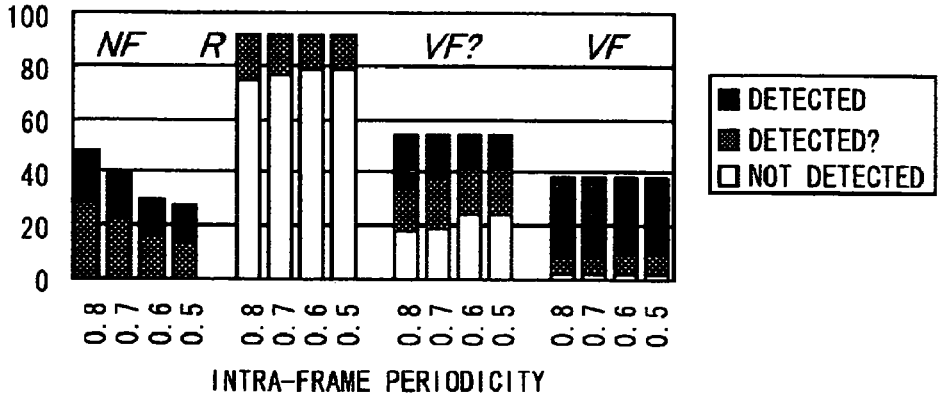
FIG. 13 shows experimental results by setting several IFP thresholds for power threshold=7 dB and IPS threshold=0.

Next, power threshold value was fixed at 7 dB and IPS threshold value was set to 0.0. FIG. 13 shows the detection results for different IFP threshold values under such conditions. Referring to FIG. 13, the detection rate did not change much (as indicated by "VF" group), but when IFP threshold value was set to 0.6, more insertion errors could be reduced (as indicated by "NF" group).

Figure 14:
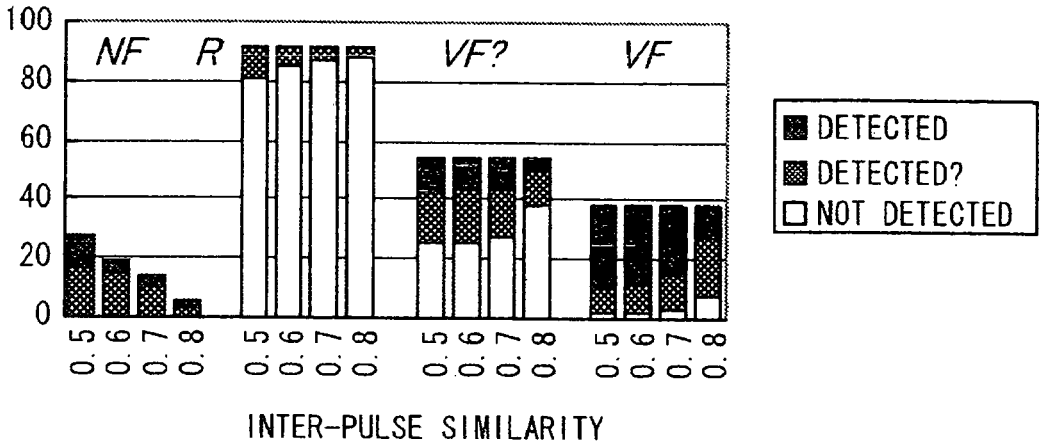
FIG. 14 shows experimental results by setting several IPS thresholds for power threshold=7 dB and IFP threshold=0.6.

Finally, several IPS threshold values were tested by setting power threshold value to 7 dB and IFP threshold value to 0.6, respectively. Referring to FIG. 14, when IPS threshold was set to 0.6, severe insertion errors could further be reduced (black portions of "NF" group), and reasonable detection rate could be maintained.

Regarding the group "R" (segments of which VF features were not perceived by humans), most of the samples were not detected as VF in automatic detection. In "VF?" group, however, part of samples was detected as "VF." The results indicate that the VF automatic detecting apparatus in accordance with the present embodiment attained results fairly consistent with the results of human perception.

A global detection rate is calculated as the summation of VFdur divided by the summation of VFdur_human. A global insertion error is calculated as the summation of VFdur_ins divided by the summation of VFdur_human. For the parameter combination of "power=7 db, IFP=0.6 and IPS=0.6," the global detection rate of 73.3% and global insertion error rate of 3.9% are obtained. The detection rate of 73.3% can still be improved by post-processing the detection results. By way of example, by merging close VF segments or by other methods, the detection rate may be improved. For applications allowing slightly higher insertion error rate without causing any problem, the detection rate may be improved by further adjusting the parameters.

As described above, according to the present embodiment, vocal fry can automatically be detected by using a combination of IFP and IPS parameters.

<Computer Implementation and Operation>

Figure 15:
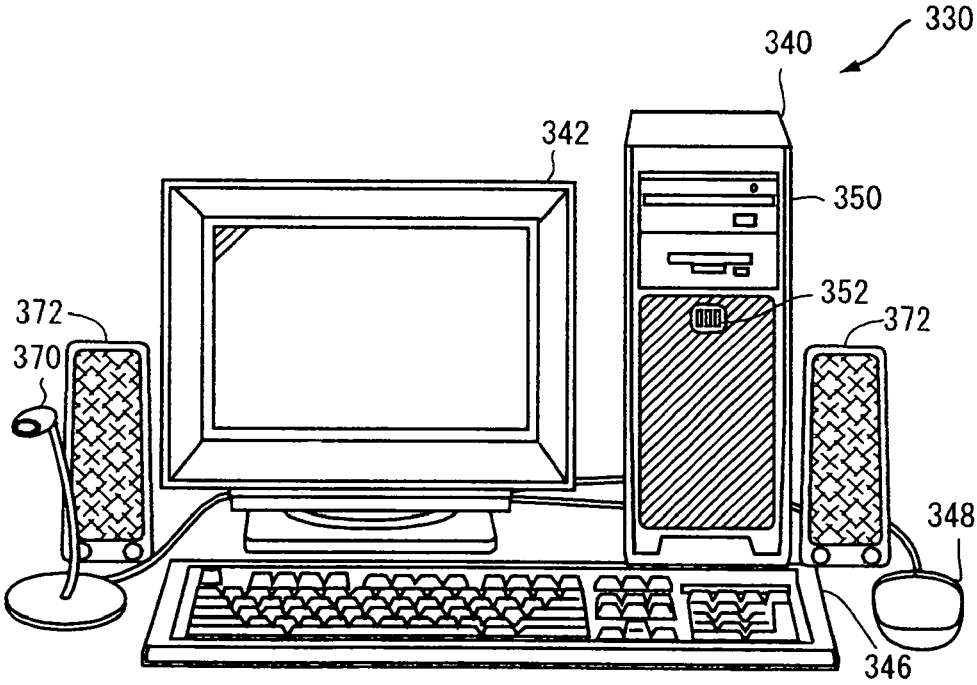
FIG. 15 shows an appearance of a computer implementing automatic communication system 100 and VF detecting apparatus 122 in accordance with an embodiment of the present invention.

VF detecting apparatus 122 and automatic communication system 100 in accordance with the present embodiment may be implemented by computer hardware, a program executed by the computer hardware and data stored in the computer hardware. FIG. 15 shows an appearance of computer system 330 and FIG. 16 shows internal configuration of computer system 330.

Referring to FIG. 15, computer system 330 includes a computer 340 having a semiconductor memory drive 352 and a DVD (Digital Versatile Disk) drive 350, a keyboard 346, a mouse 348, a monitor 342, a microphone 370 and a speaker 372.

Figure 16:
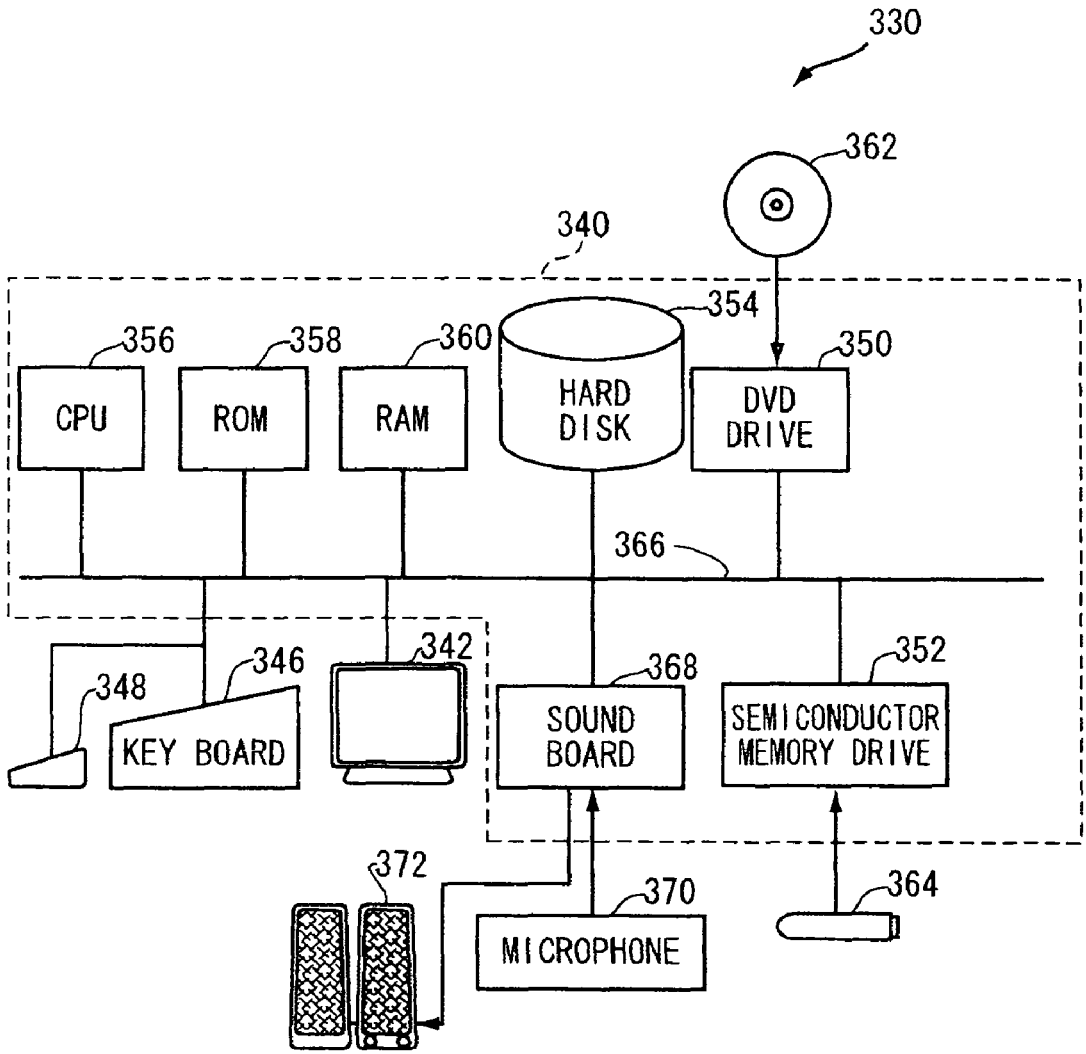
FIG. 16 shows an internal configuration of the computer shown in FIG. 15.

Referring to FIG. 16, computer 340 includes, in addition to semiconductor memory drive 352 and DVD drive 350, a CPU (Central Processing Unit) 356, a bus 366 connected to CPU 356, semiconductor memory drive 352 and DVD drive 350, a read only memory (ROM) 358 storing a boot-up program and the like, a random access memory (RAM) 360 connected to bus 366 and storing program instructions, system program, work data and the like, and a sound board 368 for converting a speech signal input from microphone 370 to a digital signal or converting digital speech signal processed by CPU 356 to an analog signal and applying it to speaker 370. Computer system 330 may further include a printer, not shown.

Though not shown, computer 340 may further include a network adaptor board providing connection to local area network (LAN).

The computer program causing computer system 330 to operate as the automatic communication system 100 and VF detecting apparatus 122 in accordance with the present embodiment may be stored on a DVD disk 362 or semiconductor memory 364 loaded to DVD drive 350 or semiconductor memory drive 352, and further transferred to hard disk 354 Alternatively, the program may be transmitted to computer 340 through a network, not shown, and stored in hard disk 354. The program is loaded to RAM 360 when executed. The program may be directly loaded to RAM 350 from DVD disk 362, semiconductor memory 364 or through the network.

The program includes a plurality of instructions causing computer 340 to operate as automatic communication system 100 and VF detecting apparatus 122 in accordance with the present embodiment. Some of the basic functions to execute the processes in accordance with these instructions are provided by the operating system (OS) operating on computer 340, a third party program or various tool kit modules installed in computer 340. Therefore, the program may not necessarily include all the functions to realize the operation of automatic communication system 100 and VF detecting apparatus 122 in accordance with the present embodiment. The program may include only the instructions to execute the operation of automatic communication system 100 and VF detecting apparatus 122 described above, by calling appropriate functions or "tools" in a controlled manner to attain desired results. The operation of computer system 330 is well known and, therefore, detailed description will not be given here.

Power threshold storage unit 198 shown in FIG. 3, periodicity threshold value function storage unit 262 shown in FIG. 7 and inter-pulse similarity threshold value storage unit 314 shown in FIG. 11 are all implemented with RAM 360 and registers in CPU 356, shown in FIG. 16.

The embodiments as have been described here are mere examples and should not be interpreted as restrictive. The scope of the present. invention is determined by each of the claims with appropriate consideration of the written description of the embodiments and embraces modifications within the meaning of, and equivalent to, the languages in the claims.

INDUSTRIAL APPLICABILITY

The present invention is applicable to a system for detecting VF segments from a speech signal and obtaining paralinguistic information from the speech signal based on the detected VF segments, as well as to a man-machine interface enabling appropriate response based on the paralinguistic information.

The invention claimed is:

1. A vocal fry detecting apparatus for detecting a vocal fry section in a speech signal, comprising:

a first framing unit configured to frame the speech signal with a first frame having a first frame length and shifted by a first frame shift amount;

a power peak detecting unit configured to detect power peak in each of a series of first frames output from said first framing unit;

a second framing unit configured to frame said speech signal with a second frame having a second frame length longer than said first frame length and shifted by a second frame shift amount larger than said first frame shift amount;

a periodicity determining unit configured to determine presence or absence of periodicity in said speech signal in each of a series of second frames output from said second framing unit;

a power peak selecting unit configured to select, from among the power peaks detected by said power peak detecting unit, a power peak in said second frame determined by said periodicity determining unit to have no periodicity; and a searching unit configured to search, for each of the power peaks selected by said power peak selecting unit, for a power peak having cross-correlation with another power peak in a prescribed section including said power peak in said speech signal, larger than a prescribed threshold, and detect the prescribed section including the power peak in said speech signal as the vocal fry section.

2. The vocal fry detecting apparatus according to claim 1, wherein said periodicity determining unit includes:

a calculating unit configured to calculate, in each of said series of second frames, an in-frame periodicity measure of the maximum power peak in said frame, as a function of auto-correlation in a prescribed lag range in the frame, and to determine presence or absence of periodicity, depending on whether auto-correlation peak is larger than a prescribed threshold function or not; and a periodicity correcting unit configured to correct a value of said periodicity measure of said second frame other than in a portion where a prescribed number of continuous frames have said periodicity measure larger than a predetermined constant, among said second frames determined by said searching unit to have periodicity, to a value that is to be determined to have no periodicity.

3. The vocal fry detecting apparatus according to claim 1, further comprising;

a filtering unit configured to filter out frequency components outside a prescribed frequency band of said speech signal, before applying said speech signal to said first and second framing units.

4. A non-transitory recording medium storing a vocal fry detecting program, for detecting a vocal fry period in a speech signal using a computer, wherein said vocal fry detecting program includes:

a first framing program portion for framing the speech signal with a first frame having a first frame length and shifted by a first frame shift amount;

a power peak detecting program portion for detecting power peak in each of a series of first frames output from said first framing program portion;

a second framing program portion for framing said speech signal with a second frame having a second frame length longer than said first frame length and shifted by a second frame shift amount larger than said first frame shift amount;

a periodicity determining program portion for determining presence or absence of periodicity in said speech signal in each of a series of second frames output from said second framing program portion;

a power peak selecting program portion for selecting, from among the power peaks detected by said power peak detecting program portion, a power peak in said second frame determined by said periodicity determining program portion to have no periodicity; and a searching program portion for searching, for each of the power peaks selected by said power peak selecting program portion, for a power peak having cross-correlation with another power peak in a prescribed section including said power peak in said speech signal, larger than a prescribed threshold, and detecting the prescribed section including the power peak in said speech signal as the vocal fry section.

5. The non-transitory recording medium storing the vocal fry detecting program according to claim 4, wherein said periodicity determining program portion includes a program portion for calculating, in each of said series of second frames, in-frame periodicity measure of the maximum power peak in said frame, as a function of auto-correlation in a prescribed lag range in the frame, and for determining presence or absence of periodicity, depending on whether auto-correlation peak is larger than a prescribed threshold function or not; and a periodicity correcting program portion for correcting a value of said periodicity measure of said second frame other than in a portion where a prescribed number of consecutive frames have said periodicity measure larger than a predetermined constant, among said second frames determined by said searching program portion to have periodicity, to a value that is to be determined to have no periodicity.

6. The non-transitory recording medium storing a vocal fry detecting program according to claim 4, further comprising a filtering program portion for filtering out frequency components outside a prescribed frequency band of said speech signal, before applying said speech signal to said first and second framing program portion.

* * * * *